US010644464B1

(12) United States Patent
Roberts et al.

(10) Patent No.: US 10,644,464 B1
(45) Date of Patent: May 5, 2020

(54) APPARATUS AND METHOD FOR ADDRESSING A DEVICE

(71) Applicant: JOHNSON CONTROLS FIRE PROTECTION LP, Boca Raton, FL (US)

(72) Inventors: James Roberts, Amherst, NH (US); Zibran Aziz Khan, Worcester, MA (US)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

(21) Appl. No.: 16/421,693

(22) Filed: May 24, 2019

(51) Int. Cl.

| | |
|---|---|
| ***H01R 13/71*** | (2006.01) |
| ***H01R 13/24*** | (2006.01) |
| ***H01R 12/72*** | (2011.01) |
| ***H01R 13/70*** | (2006.01) |

(52) U.S. Cl.
CPC ..... *H01R 13/71* (2013.01); *H01R 12/72* (2013.01); *H01R 13/24* (2013.01); *H01R 13/701* (2013.01)

(58) Field of Classification Search
CPC ..... H01H 1/58; H01H 1/5866; H01H 1/5805; H01H 1/5833; H01H 13/71; H01H 13/24; H01H 13/701; H01H 12/72
USPC ..... 200/51 R, 51.02–51.05, 51.07, 51.09, 200/51.12
See application file for complete search history.

(56) References Cited

U.S. PATENT DOCUMENTS 3,849,610 A * 11/1974 Lockard ..... H01H 15/005 200/5 R
3,858,012 A * 12/1974 Lockard ..... H01H 9/04 200/16 D
3,900,709 A * 8/1975 Sheesley ..... H01H 1/5805 200/5 R
3,945,808 A * 3/1976 Sheesley ..... H01H 1/5805 428/591
3,999,287 A * 12/1976 Lockard ..... H01H 9/0271 29/622
4,081,632 A * 3/1978 Schaffeler ..... H01H 19/62 200/239
4,311,884 A * 1/1982 Henley ..... H01H 23/006 200/16 R
4,324,956 A * 4/1982 Sakakino ..... H01H 15/005 200/16 R
4,540,858 A * 9/1985 Knoop ..... G06F 1/183 200/315

(Continued)

*Primary Examiner* — Gary F Paumen
(74) *Attorney, Agent, or Firm* — Arent Fox LLP

(57) ABSTRACT

An addressing device and method for addressing an addressed device configured to be removeably engaged with the addressing device. The addressing device includes a series of addressing device contacts that are individually and selectively configured to move from a first contact position to a second non-contact position via a respective switch. In the first contact position, an addressing device contact forms an electrical connection with a respective addressed device contact when the addressing device and the addressed device are in the engaged position. In the second non-contact position the addressing device contact does not form an electrical connection with a respective contact of the addressed device. The sequence of continuity provided to the addressed device by the selective contact or non-contact of the addressing device contacts is used to set an address of the addressed device.

17 Claims, 9 Drawing Sheets

(56) References Cited

U.S. PATENT DOCUMENTS

| | | | | | |
|---|---|---|---|---|---|
| 4,753,000 | A * | 6/1988 | Stearns | H01H 15/005 | 200/407 |
| 4,975,548 | A * | 12/1990 | Brouilette | H01H 23/168 | 200/5 R |
| 5,075,516 | A * | 12/1991 | Brouillette | H01H 23/006 | 200/408 |
| 7,371,979 | B2 * | 5/2008 | Fuzetti | H01R 9/2433 | 200/17 R |

* cited by examiner

APPARATUS AND METHOD FOR ADDRESSING A DEVICE

FIELD OF THE INVENTION

The present disclosure relates generally to an apparatus and method for setting the digital address of a device. More specifically, the present disclosure relates to an apparatus and method for setting the address of a detection device for use on a communication network.

BACKGROUND

A common form of communication network relies on a single set of system lines extending from a controller to a number of addressable devices. For example, such networks are used in fire detection systems, carbon monoxide detection systems, or other building monitoring systems where the addressable devices may be smoke detectors, heat detectors, carbon monoxide detectors, and alarm indicators, to name a few examples. In the aforementioned network, the addressable devices may be connected to bases or mounts connected to the communication network. Each of the variety of devices may require its own digital address which distinguishes it from other devices and to which it responds when a controller connected to the communication network presents the specific address on the system lines.

Many approaches are used for establishing the individual addresses of the addressable devices. For example, the addresses may be established electronically during an initialization process of the addressable device. Alternatively, the address may be set manually by the individual who installs the device. For example, a dual-in-line package (DIP) switch may be provided on the addressable device. The electronics of the device are able to read the binary state of several switches in a DIP switch and read that state as the device address.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In accordance with one aspect of the disclosure, an addressing device configured to be removably engaged with an addressed device is disclosed. At least one of the addressing device and the addressed device are moveable from a non-engaged position to an engaged position, wherein the addressing device further includes a constant contact configured to contact an addressed device constant contact when the addressing device and the addressed device are in the engaged position. The addressing device may further include a first switch and a first contact that is electrically connected to the constant contact, wherein the first switch is configured to move the first contact from a first position to a second position. In the first position, the first contact forms an electrical connection with a first addressed device contact when the addressing device and the addressed device are in the engaged position. In a second position the first contact forms an open electrical connection with the first addressed device contact when the addressing device and the addressed device are in the engaged position. The addressing device further includes a second switch and a second contact that is electrically connected to the constant contact, wherein the second switch is configured to move the second contact from a first position to a second position. In the first position the second contact forms an electrical connection with a second addressed device contact when the addressing device and the addressed device are in the engaged position, and wherein in the second position the second contact forms an open electrical connection with the second addressed device contact when the addressing device and the addressed device are in the engaged position.

In accordance with another aspect of the disclosure, an addressing device and an addressed device that is configured to be removably engaged with the addressed device is disclosed. The addressing device includes a constant contact configured to contact a respective addressed device constant contact when the addressing device and the addressed device are in the engaged position and a first contact that is electrically connected to the constant contact. The addressing device further includes a first switch, wherein the first switch is configured to move the first contact from a first position to a second position, wherein in a first position the first contact forms an electrical connection with a first addressed device contact when the addressing device and the addressed device are in the engaged position. When the switch is in a second position, the first contact forms an open electrical connection with the first addressed device contact when the addressing device and the addressed device are in the engaged position. The addressing device further includes a second contact that is electrically connected to the constant contact and the first contact and a second switch. The second switch is configured to move the second contact from a first position to a second position, wherein in a first position the second contact forms an electrical connection with a second addressed device contact when the addressing device and the addressed device are in the engaged position. When the switch is in the second position the second contact forms an open electrical connection with the second addressed device contact when the addressing device and the addressed device are in the engaged position.

In accordance with another aspect of the disclosure, an addressed device configured to be removably engaged with and addressed by an addressing device comprising a constant contact, a first contact, and a second contact, is disclosed. The addressed device includes an addressed device constant contact configured to provide continuity with a constant contact of the addressing device when the addressing device and the addressed device are in the engaged position, and a first addressed device contact configured to be selectively contacted by a first contact of the addressing device when the addressing device and addressed device are in the engaged position. The addressed device further includes a second addressed device contact configured to be selectively contacted by the second contact of the addressed device when the addressing device and addressed device are in the engaged position, wherein the selective engagement of the first addressing device contact and the second addressing device contact with the first addressed device contact and the second addressed device contact provides a continuity sequence which sets an address of the addressed device.

Additional advantages and features of these aspects will be set forth in part in the description that follows, and in part will become more apparent to those skilled in the art upon examination of the following or upon learning by practice of the disclosure.

BRIEF DESCRIPTION OF THE DRAWINGS

The features believed to be characteristic of one or more aspects of the disclosure are set forth in the appended claims.

In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure will be best understood by reference to the following detailed description of illustrative aspects of the disclosure when read in conjunction with the accompanying drawings, wherein.

DETAILED DESCRIPTION

Figure 1:
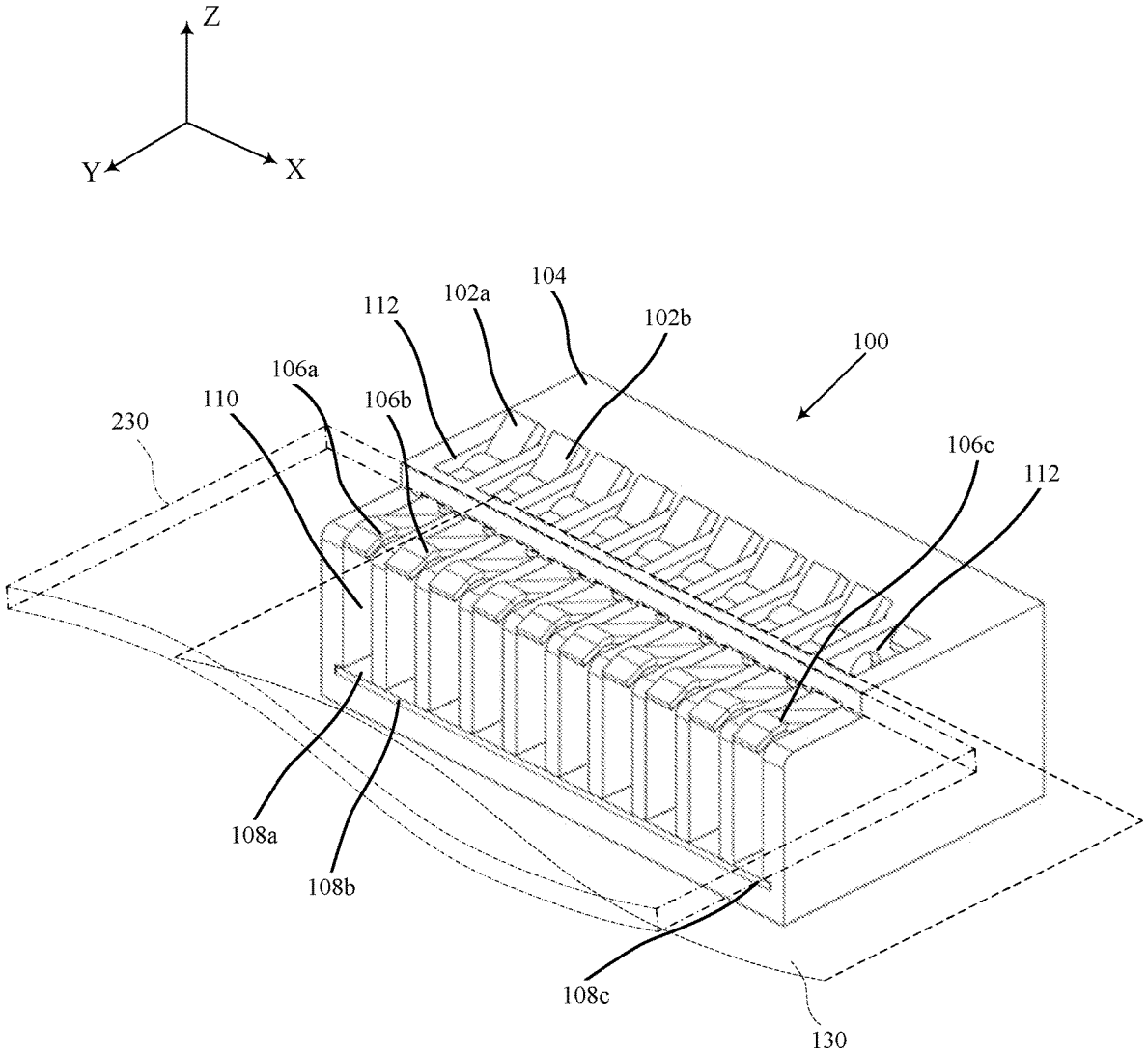
FIG. 1 is perspective view of an addressing device in accordance with one aspect of the disclosure.

The following includes definitions of selected terms employed herein. The definitions include various examples and/or forms of components that fall within the scope of a term and that may be used for implementation. The examples are not intended to be limiting. Further, it will be obvious to one skilled in the art that the present invention may be practiced without these specific details. In other instances, well-known methods, procedures, and components have not been described in detail so as to not unnecessarily obscure aspects of the present invention.

Throughout the disclosure the term substantially may be used as a modifier for a geometric relationship between elements or for the shape of an element or component. While the term substantially is not limited to a specific variation and may cover any variation that is understood by one of ordinary skill in the art to be an acceptable variation, some examples are provided as follows. In one example, the term substantially may include a variation of less than 10% of the dimension of the object or component. In another example, the term substantially may include a variation of less than 5% of the object or component. If substantially is used to define the angular relationship of one element to another element, one non-limiting example of the term substantially may include a variation of 5 degrees or less. These examples are not intended to be limiting and may be increased or decreased based on the understanding of acceptable limits to one of ordinary skill in the art.

For purposes of the disclosure, directional terms are expressed generally with relation to a standard frame of reference shown by the axis in each respective figure when the addressing device or addressed device are installed and in an in-use orientation.

The term "addressing device" is used throughout the disclosure. In the example aspects described throughout the specification, an example of an addressing device used with a sensor or detector mount is described. However, the addressing device described herein is not limited to such a use and may be usable with any device that may be addressed or require a series of switches to be physically set either by a user or technician in the field or during a manufacturing or assembly process. Some alternative example uses of the addressing device and addressed device may include a system with features enabled or disabled by turning on or off specific DIP switches on the addressing device (and thus providing a binary sequence or continuity sequence at the addressed device) or security feature requiring a specific combination set via the series of DIP switches on the addressing device.

The term "addressed device" is used throughout the disclosure. In example aspects described throughout the specification, a sensor or detector is described that has an address set via the addressing device. However, the addressed device described herein is not limited to such a use and may be usable with any device that may be addressed or may have features enabled or disabled based on a binary sequence or continuity sequence provided by an addressing device. As mentioned above, the addressed device may be part of a system or a device with features enabled or disabled based on continuity provided between terminals of the device or a security feature requiring a specific continuity or binary sequence provided via the addressing device.

In order to provide context to the current disclosure, a broad overview of the discovered deficiencies of various systems and an example implementation of the current disclosure and the advantages provided by the disclosure are described below. Further details of example implementations of the current disclosure are described detail with reference to the figures below.

Buildings or other areas may be provided with a network of monitoring devices such as detectors/sensors that provide monitoring or provide an output for monitoring various conditions (e.g., presence of fire, carbon monoxide, excessive vibration, excessive moisture or the detection of flooding) at various locations within the building. Each of the monitoring sensors may be operatively connected via a wired and/or wireless connection to a monitoring network. Each of the monitoring devices may be physically mounted at each desired location via a base that provides a current to the monitoring device and/or provides a connection to a monitoring network. When the network of devices is installed or configured, each device on the monitoring network may be allocated a unique address code corresponding to a known location of the specific device so that a control unit or control units(s) in operative connection with the devices may selectively communicate with individual detectors at known locations on the network.

One method of providing an address corresponding to the known location of each monitoring device is to provide an addressing device, which may for example include a dual-in-line package ("DIP") switch at the mounting base of each monitoring device. The address may be set actively by altering the position of one or more DIP switch(es) connected to active electronic circuitry in the base. Another option is to uniquely programming an electronic memory connected to such circuitry in the base of each monitoring device. Providing the addressing for monitoring device at the mounting portion or base has the advantage that the address code is not altered if the monitoring device that is mounted to a single mounting portion or base is replaced by another monitoring device. However, the aforementioned addressing device requires circuitry in the mounting base for each of the monitoring devices; which increases the cost and complexity of the system.

Another method of providing an address corresponding to the known location of each monitoring device is to provide the addressing device at the removable monitoring device instead of at the mounting base. This method has the advantage that all of the circuitry (i.e. sensor electronics and the address electronics) may be incorporated into each monitoring device thereby reducing the cost reducing the complexity of the system by not requiring circuitry in the mounting base of the monitoring device. However, the disadvantage of such a system is that when a monitoring device is removed from its base for replacement or maintenance, the new monitoring device may not be properly addressed or the monitoring device may accidentally be swapped with a another monitoring device having an incorrectly set address.

The current disclosure relates to a method and apparatus for improving the reliability, reducing the possibility of operator error, and/or reducing the cost of the monitoring devices and/or corresponding mounting bases used in a monitoring network by providing a passive addressing device usable with the base of each monitoring device. The address of the addressing device may be set via a series of DIP switches which are configured to move a respective terminal for each DIP switch from a contact position to a non-contact position and vise-versa. A monitoring device, which may hereinafter be interchangeably referred to as an addressed device, usable with the system may include a series of terminals that correspond with each terminal of the addressing device. When a monitoring device having the aforementioned series of terminals is installed onto the base with the disclosed addressing device, each terminal of the addressing device may align with a respective terminal on the monitoring device. When the monitoring device is installed onto a respective base, the position of each DIP switch of the addressing device causes each respective terminal of the addressing device to either contact or not contact a respective one of the series of terminals of the monitoring device. Thus, an address of each detection location may be set at the mounting base of each monitoring device so that when a monitoring device is connected to the base, the selective contact of the terminals of the addressing device create a continuity sequence at the monitoring device that is used to determine the address of the monitoring device. Further details of the disclosure are described below with reference to the figures below.

FIG. 1 shows one example of an addressing device 100, which may for example be mounted to a base 130 that is capable of receiving or connecting to an addressed device 230. The addressing device 100 may for example include a series of addressing terminals (e.g., 108*a*, 108*b*, 108*e*) each one of which may include an addressing device contact (e.g., 106*a*, 106*b*, 106*c*, 106*e*). It is noted that FIGS. 1, 2A, 3A, 3B, 5, and 6 show an example addressing device with ten addressing device contacts, the concept of the disclosure is not limited to any specific number of addressing device contacts and thus any number of contacts may be provided. Further, since any one of or a combination of the contacts of the addressing device may function in a similar or identical fashion, only a couple of examples of, and not all of the addressing device contacts will be specifically discussed throughout the disclosure for simplicity purposes. Further, throughout the disclosure, each component that may include duplicates may, for example, include a reference number proceeded with a letter (e.g., a, b, c), if a reference number is not proceeded with a letter, the features discussed may be applicable to all similar components that include the same numerical reference number.

As shown in FIG. 1, the addressing device 100 may include a first addressing device terminal 108*a* and a second addressing device terminal 108*b*. Each one of the first and second addressing device terminals 108*a-b* may be formed as a metallic biasing member or spring that is biased in the Z-direction in FIG. 1 when the each respective terminal is disposed within the housing 104 of the addressing device 100. The first and second addressing device terminals 108*a-b* may further include a respective first contact portion 106*a* and a second contact portion 106*b*, which may hereinafter be interchangeably referred to as a first contact 106*a* and a second contact 106*b*. In one example, the first contact portion 106*a* and the second contact portion 106*b* may for example be plated with or include a contact area formed of phosphor bronze, nickel, gold, silver, and/or platinum to improve the electrical conductivity and/or to prevent degradation of the electrical conductivity of the first contact portion 106*a* and the second contact portion 106*b*.

Figure 2A:
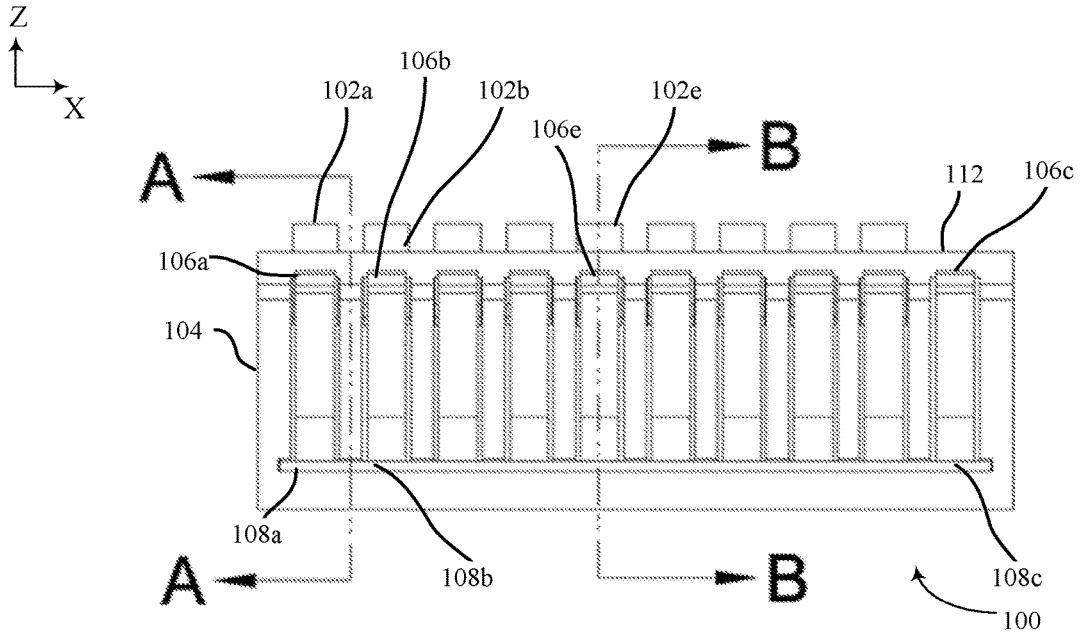
FIG. 2A is a front view of the addressing device of FIG. 1 in accordance with one aspect of the disclosure.
Figure 2B:
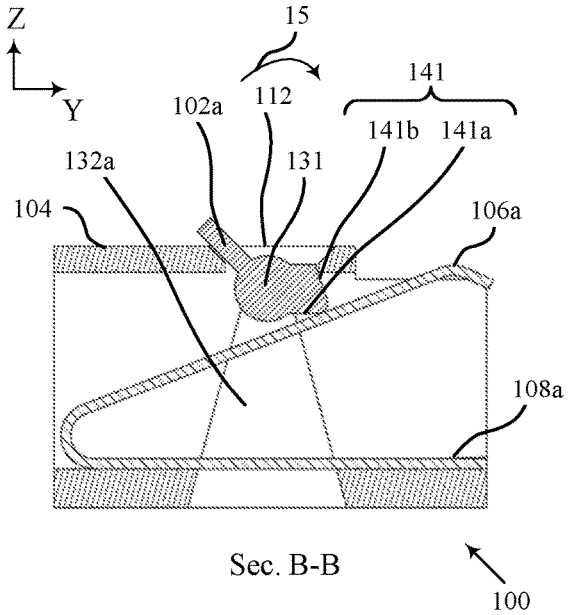
FIG. 2B is a cross-sectional view about section B-B of the addressing device of FIGS. 1 and 2A in accordance with one aspect of the disclosure.
Figure 2C:
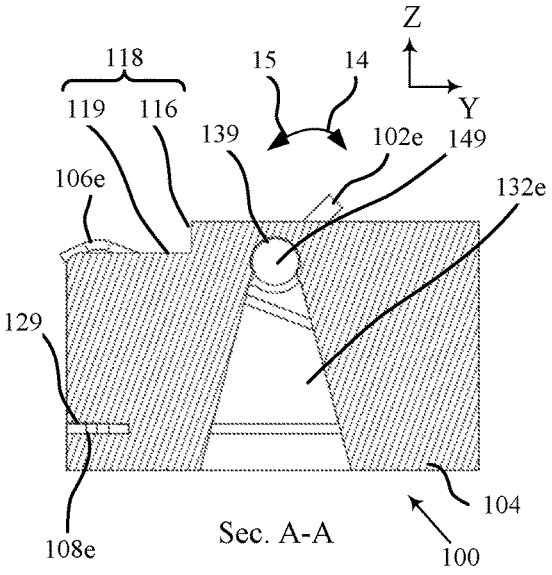
FIG. 2C is a cross-sectional view about section A-A of the addressing device of FIGS. 1 and 2A in accordance with one aspect of the disclosure.

As best shown in FIG. 2C, the addressing device 100 may include an receiving portion 118 configured to engage with a received portion 218 (FIG. 3A) of an addressed device. The receiving portion 118 may include a receiving vertical surface 116 configured to abut a received vertical surface 226 of the addressed device 230 and a receiving horizontal surface 119 configured to abut a received horizontal surface 219 of the addressed device 230 when the addressed device is moved from a non-engaged position to an engaged position. For example, in one aspect shown in FIG. 3A, the addressed device 230 may be rotatably engaged with a base containing the addressing device 100 in direction 12 thus causing the receiving vertical surface 116 (FIG. 2C) to abut a received vertical surface 226 (FIG. 3A) of the addressed device 230 and a receiving horizontal surface 119 to abut a received horizontal surface 219 of the addressed device 230. When the addressed device 230 is engaged with the addressing device, a first series of addressed device terminals each having an addressed device contact (e.g., 226*a*, 226*b*, and 226*c*) may be aligned with and capable of forming an electrical connection with the addressing device via each corresponding contact portion (e.g., 106*a*, 106*b*, and 106*c*) of the addressing device. In one non-limiting example, the received portion 218 of the addressed device may be a printed circuit board ("PCB") or a section of a PCB including the aforementioned series of terminals (e.g., 226*a*, 226*b*, 226*c*).

The addressing device may further include a series of switches (e.g., 102*a*, 102*b*, and 102*e*). Each one of the series of switches may be rotatably supported within the housing 104 of the addressing device 100. FIG. 2A shows a front view of an addressing device in accordance with one aspect of the disclosure. FIGS. 2*b* and 2C show cross sectional views about sections A-A and B-B respectively. It is noted that while different components and reference numbers are referenced with respect to FIGS. 2B and 2C, similar structures with each of the plurality of terminals and switches shown in FIGS. 1, 2A, 3A, 3B, and 5. As shown in 2B-2C, one example of a first switch 102*a* and a third switch 102*e* may be rotatable about a first axis 131 (FIG. 2B) when installed within the housing of 104 of the addressing device 100 via a switch installation channel 132*a* and 132*b*. For example, the third switch 102*e* may have a shaft 149 that is press fit into a receiving portion 139 of the housing 104. Once the shaft 149 of the third switch 102*e* is press fit into the receiving portion 139 of the housing 104, the third switch 102*e* may be configured to rotate (e.g., in a first direction 114 and a second direction 15 about the first axis 131 (FIG. 2B). Further, as best shown in FIG. 2B, each of the switches may protrude through a corresponding opening 112 in the housing 104 thus allowing a user to rotate the switch as described in further detail below. As shown with respect the first switch 102*a*, each switch may further include a contacting region 141 having a first portion 141*a* which may contact a first addressing device terminal and a second portion 141*b* that extends further from a first axis 131 of the switch than the first portion 141*a* and is configured to contact a first addressing device terminal 108*a*. As described in further detail below, the rotation of the first switch 102*a* in direction 15 (FIG. 2B) causes the second portion 141*b* of the switch 102*a* to press down on the first addressing device terminal 108*a* thus causing a first contact portion 106*a* to move in a downward Z-direction from a position in contact with a respective terminal of the addressed device (i.e., a position that provides continuity between the respective terminal of the addressed device) to a position out of contact (i.e., a position that does not provide continuity between the respective terminal of the addressed device) with a respective terminal of an addressed device. A position that is out of contact or does not provide continuity between the respective terminal of the addressed device may hereinafter be interchangeably referred to as an open electrical contact or as forming an open electrical contact.

Figure 3A:
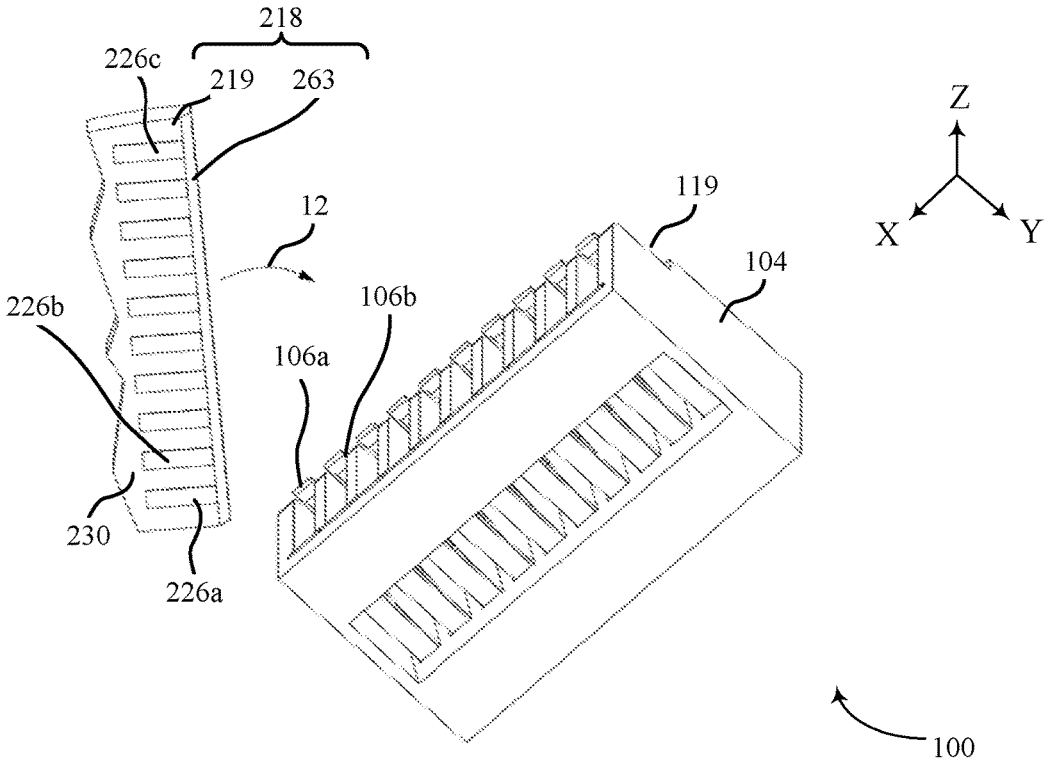
FIG. 3A is a bottom perspective view of an addressing device and an addressed device in a separated position in accordance with one aspect of the disclosure.
Figure 3B:
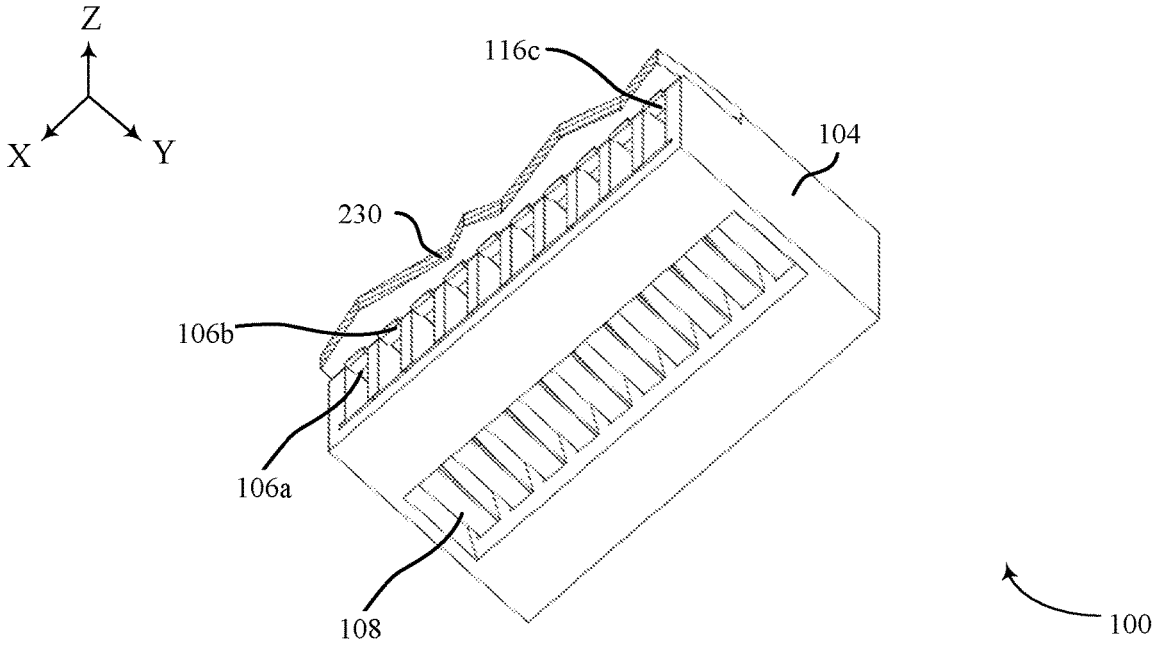
FIG. 3B is a bottom perspective view of the addressing device and addressed device of FIG. 3A in an engaged position in accordance with one aspect of the disclosure.
Figure 4A:
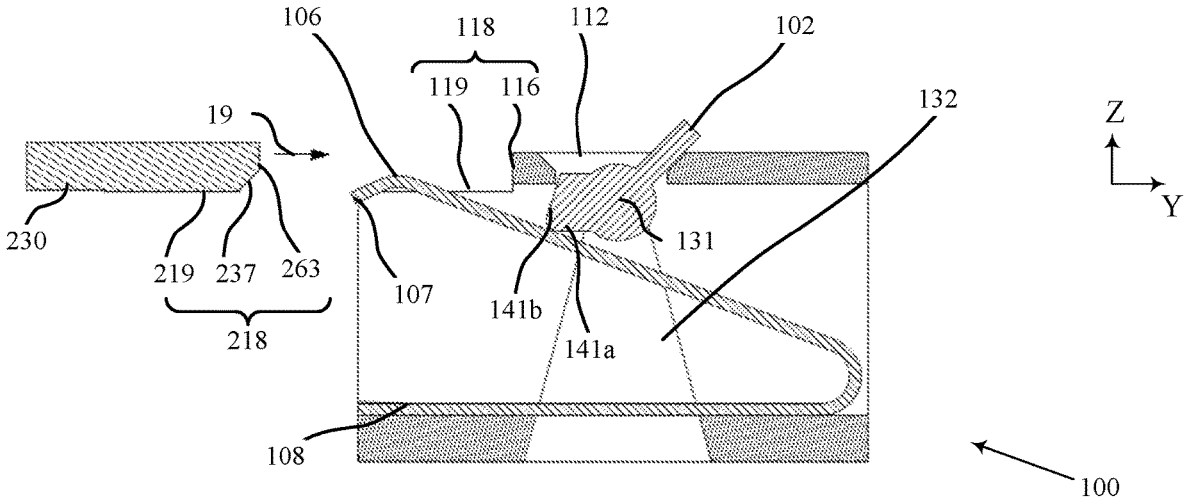
FIG. 4A is a cross-sectional view of the addressing device of FIGS. 1-3B and an addressed device in a separated position in accordance with one aspect of the disclosure.
Figure 4B:
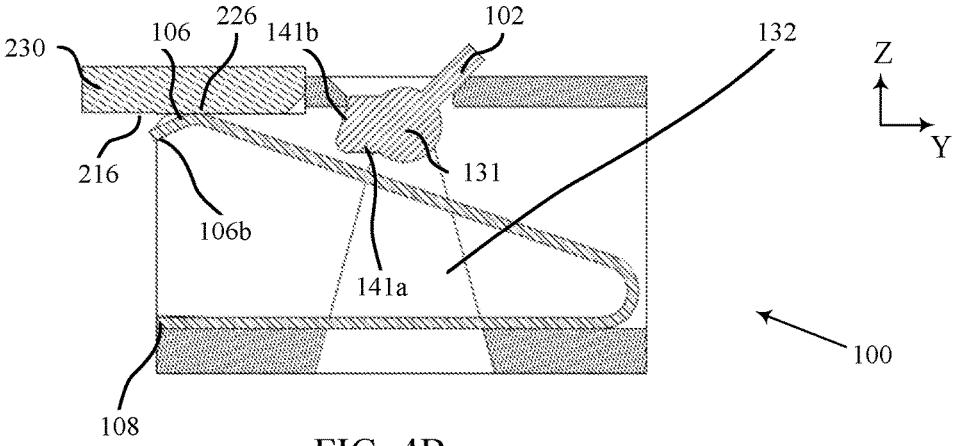
FIG. 4B is a cross-sectional view of the addressing device of FIGS. 1-4A and an addressed device in the engaged position and in a first operational position in accordance with one aspect of the disclosure.
Figure 4C:
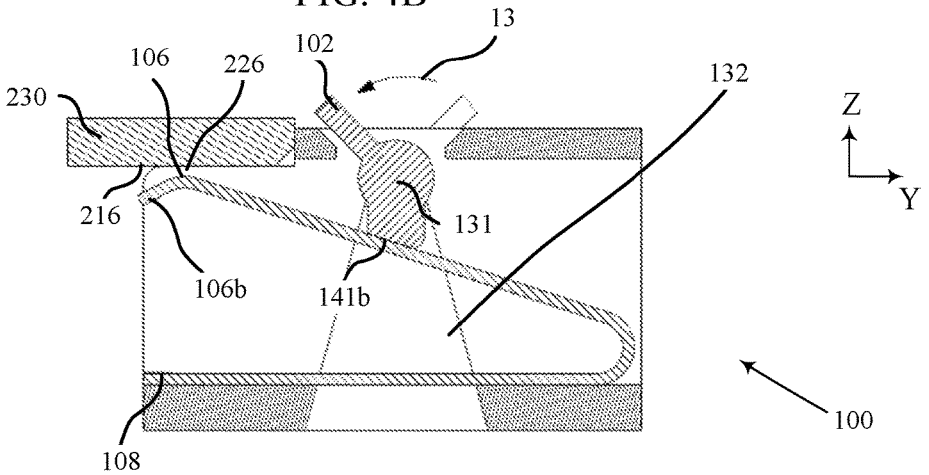
FIG. 4C is a cross-sectional view of the addressing device of FIGS. 1-4B and an addressed device in the engaged position and in a second operational position in accordance with one aspect of the disclosure.

FIGS. 4A-4C show an example operation of each one of the switches and terminals of the addressing device 100. As mentioned above, while only a single switch is shown, substantially similar or identical operation and structure is applicable to each one of the switches shown throughout the figures. As shown in FIG. 4A, an addressed device may be installed onto a base containing the addressing device 100 in direction 19. As shown in FIG. 3A, the addressed device 230 may be installed in a rotational direction 12, or direction 19 as shown in FIG. 4A. As an alternative, the addressed device 230 may be installed in a linear direction. The received portion 218 of the addressed device 230 may include a series of terminals (e.g., 226*a*, 226*b*, and 226*c*) as best shown in FIG. 3A, which may be interchangeably referred to as addressed device contact(s). The received portion 218 of the addressed device may further include a chamfered edge 237 to allow the received portion 218 to slide over an addressing device contact portion 106, which may be interchangeably referred to as a contact and abut respective contact surfaces of the receiving portion 118. As best shown in FIGS. 4A-4C, each terminal 108 may further include a ramp portion 107 to allow the respective addressed device contact (e.g., 226*a*, 226*b*, and 226*c*) and a the receiving portion 218 to slide over the addressing device contact portion 106 and into engagement with the receiving portion 118.

Turning to FIG. 4B, when the received portion 218 of the addressed device is engaged with the receiving portion 118 of the addressing device 100, a contact 106 of the addressing device may be in one of two positions based on the position of switch 102. As shown in FIG. 4A, if a switch 102 is in a first position, a first portion 141*b* of the first switch is out of contact or provides minimal force to terminal 108 and thus the addressing device contact contacts an addressed device contact 226 and provides continuity between the respective addressing device contact 108 and the addressed device contact 226.

FIG. 4C shows one example of a second position of the contact of the addressing device. If the switch 102 is in a second position, for example due to the rotation of switch 102 in direction 13, a second portion 141*b* of the first switch contacts the terminal 108 and presses the terminal in a downward Z direction which causes the addressing device contact portion 106 to not contact and maintain a spaced relationship from an addressed device contact 226 thus preventing electrical connection or continuity between the respective terminal of the addressed device contact 226 and the addressing device contact 108. Further the shape of the second portion 141*b* causes the switch 102 to remain in the second position until a user provides a force opposite in direction to direction 13.

The addressing device may further include a ground or constant contact terminal 108*c* (FIG. 1). As shown in the example circuit diagram shown in FIG. 6, the constant contact terminal 108*c* may be connected to a ground 300 and may be connected to the series of terminals (e.g. 108*a*, 108*b*) of the addressing device. The ground or constant contact terminal 108*c* with contact portion 106*c* may be provided via a terminal similar to the aforementioned terminals 108*a* and 108*b*, but the terminal 108*c* may not include a corresponding switch (e.g., as shown by opening 112 in FIG. 1). Thus, the ground or constant contact terminal 108*c* may remain in the first position as described above thus providing constant continuity between the contact portion 106*c* of the ground or constant contact terminal 108*c* of the addressing device and a respective ground or constant contact terminal 226*c* of the addressed device 230.

The addressed device 100 and/or monitoring network to which the addressed device is connected may set the address of the addressed device based on the position of each of the series of switches (e.g., 102*a*, 102*b*, 102*e*) discussed above. For example, turning to FIG. 4B, when the received portion 218 of the addressed device is engaged with the receiving portion 118 of the addressing device 100, a contact of the addressing device may be in one of two positions based on the position of switch 102. As shown in FIG. 4A, if a switch 102 is in a first position, a first portion 141*a* is out of contact or provides minimal force to terminal 108 and thus the addressing device contact contacts an addressed device contact 226 providing continuity between the respective addressing device contact 108 and the addressed device contact 226. The addressed device and/or monitoring network may detect the continuity between the constant contact 108*c*, and thus the addressed device may be assigned a first address based on the position of switch 102.

Further, If the switch 102 is in a second position, for example, due to the rotation of switch 102 in direction 13, a second portion 141*b* contacts the terminal 108 and presses the terminal in a downward Z direction which causes the addressing device contact portion 106 to not contact and maintain a spaced relationship from an addressed device contact 226 thus preventing electrical connection or continuity between the respective terminal of the addressed device contact 226 and the addressing device contact 108. The addressed device 100 and/or the monitoring network may detect that the addressing device contact portion 106 is not in continuity with addressed device contact 226 and thus the addressed device may be assigned a second address that is different from aforementioned first address. While an example of only a single switch is discussed in depth above, any one of or combination of the nine switches shown in FIGS. 1, 2A, 3A, 3B, and 5 may be set to a first position or a second position as discussed above. Thus, in the example shown above with nine switches (not including the constant contact terminal 108*c*) the addressed device may be set to any one of five hundred and twelve possible addresses based on the positions of each of the nine switches. Further, as mentioned above, the addressing device may include any number of switches. Thus, if the number of switches and respective selectively engageable terminals provided is X, the addressing device may be set to any one of 2X possible addresses based on the position of the switches.

Figure 5:
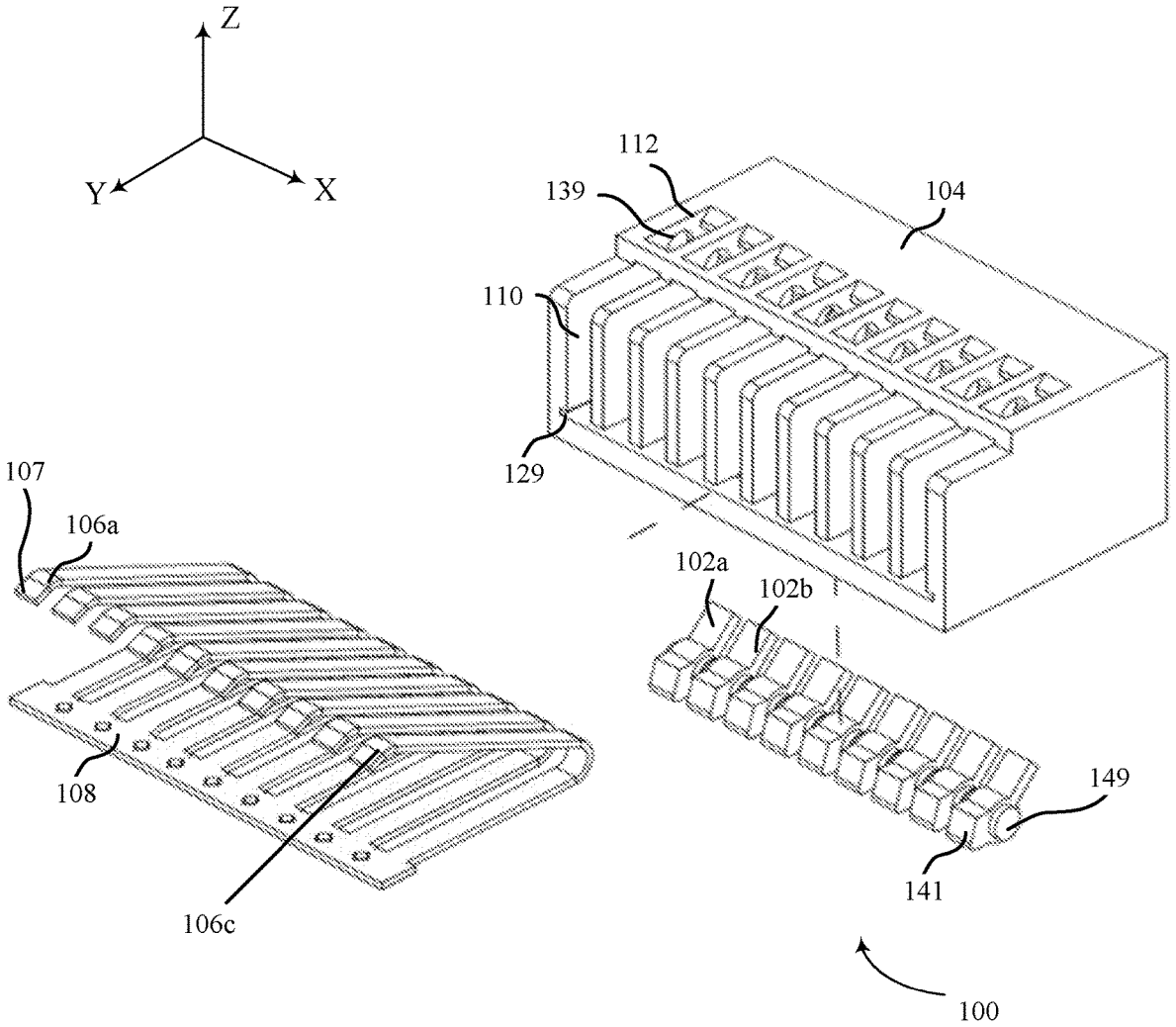
FIG. 5 is an exploded view of the addressing device of FIGS. 1-4C in accordance with an aspect of the disclosure.

FIG. 5 shows an exploded view of the example components of the addressing device 100. As shown in FIG. 5, the series of terminals 108 of the addressing device 100 may all be electrically connected and formed as a unitary structure. When assembling the addressing device 100, the plurality of switches (e.g., 102*a*, 102*b*) may be installed from the bottom of the housing 104 via switch installation channels (e.g., 132*a* and 132*e* in FIGS. 2B and 2C). Once the switches are installed into housing 104, the series of terminals 108 may be installed into the housing 104. The series of terminals may be held into the housing via a series of receiving portions (e.g., 129) that provide a friction fit or may include barbs or other locking features to lock the series of terminals into the housing 104 once they are installed.

Figure 6:
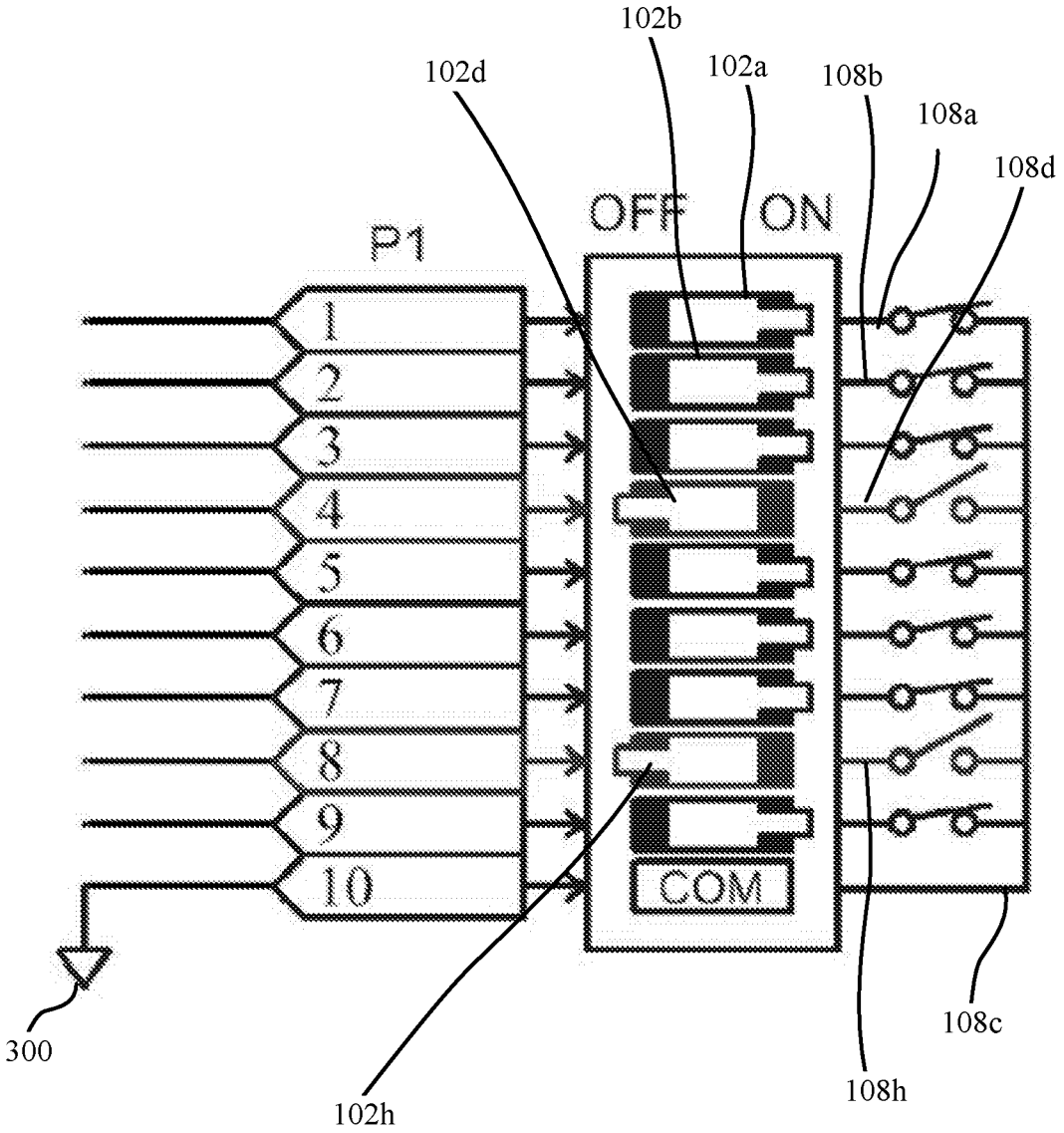
FIG. 6 is a circuit diagram of a circuit usable with the addressing device and addressed device of FIGS. 1-5 in accordance with one aspect of the disclosure.

FIG. 6 shows one example circuit diagram of the addressed device 230 and the addressing device 100 in the engaged position. As shown in FIG. 6, each of the series of terminals (e.g., 108*a*, 108*b*) and the constant contact terminal 108*c* may be electrically connected at the addressing device 100. In the example shown in FIG. 6, a fourth switch 102*d* and an eight switch 102*h* are in a second position and the remainder of the switches are in a first position. Thus, the respective terminal of each of the switches of the addressing device except for the fourth terminal 108*d* and the eight terminal 108*h* would provide continuity to ground 300 via the addressing device. The addressed device and/or the monitoring network thus determines the address of the addressed device based on the continuity sequence provided by the addressing device.

As mentioned above, the addressed device 230 may for example be a monitoring device connected to a network or monitoring network. Some examples of a monitoring device may include any one or a combination of a smoke detector, a temperature or humidity detector, a carbon monoxide detector, a vibration detector, or a flood detector. The addressed device 230 may be configured to be connected to a network via a wireless or wired connection via a base containing the addressing device 100.

Figure 7:
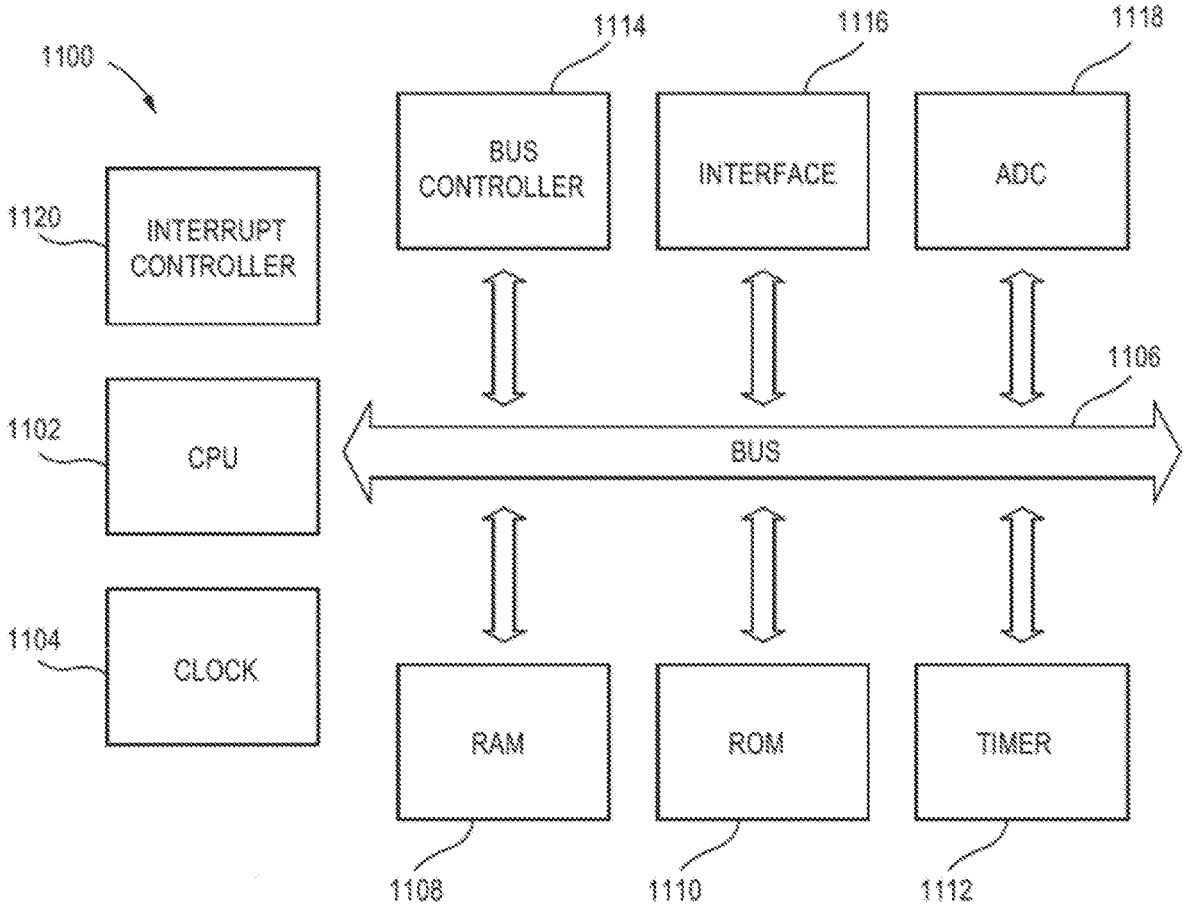
FIG. 7 shows an example representative diagram of various components of an example microcontroller for use in accordance with an aspect of the disclosure.

In some implementations, as part of or incorporating various features described herein, one or more microcontrollers may be implemented (e.g., within addressed device 230) for carrying out various operations in accordance with aspects of the present invention (e.g., for setting the address of the device on the monitoring network). Various components of such a controller 1100 are shown in representative block diagram form in FIG. 7. In FIG. 7, the controller 1100 includes a CPU 1102, clock 1104, RAM 1108, ROM 1110, a timer 1112, a BUS controller 1114, an interface 1116, and an analog-to-digital converter (ADC) 1118 interconnected via a BUS 1106.

The CPU 1102 may be implemented as one or more single core or multi-core processors, and receive signals from an interrupt controller 1120 and a clock 1104. The clock 1104 may set the operating frequency of the entire microcontroller 1100 and may include one or more crystal oscillators having predetermined frequencies. Alternatively, the clock 1104 may receive an external clock signal. The interrupt controller 1120 may also send interrupt signals to the CPU, to suspend CPU operations. The interrupt controller 1120 may transmit an interrupt signal to the CPU when an event requires immediate CPU attention.

The RAM 1108 may include one or more Static Random Access Memory (SRAM), Dynamic Random Access Memory (DRAM), Synchronous Dynamic Random Access Memory (SDRAM), Double Data-Rate Random Access Memory (DDR SDRAM), or other suitable volatile memory. The Read-only Memory (ROM) 1110 may include one or more Programmable Read-only Memory (PROM), Erasable Programmable Read-only Memory (EPROM), Electronically Erasable Programmable Read-only memory (EEPROM), flash memory, or other types of non-volatile memory.

The timer 1112 may keep time and/or calculate the amount of time between events occurring within the controller 1100, count the number of events, and/or generate baud rate for communication transfer. The BUS controller 1114 may prioritize BUS usage within the controller 1100. The ADC 1118 may allow the controller 1100 to send out pulses to signal other devices.

The interface 1116 may comprise an input/output device that allows the controller 1100 to exchange information with other devices. In some implementations, the interface 1116 may include one or more of a parallel port, a serial port, or other computer interfaces.

Figure 8:
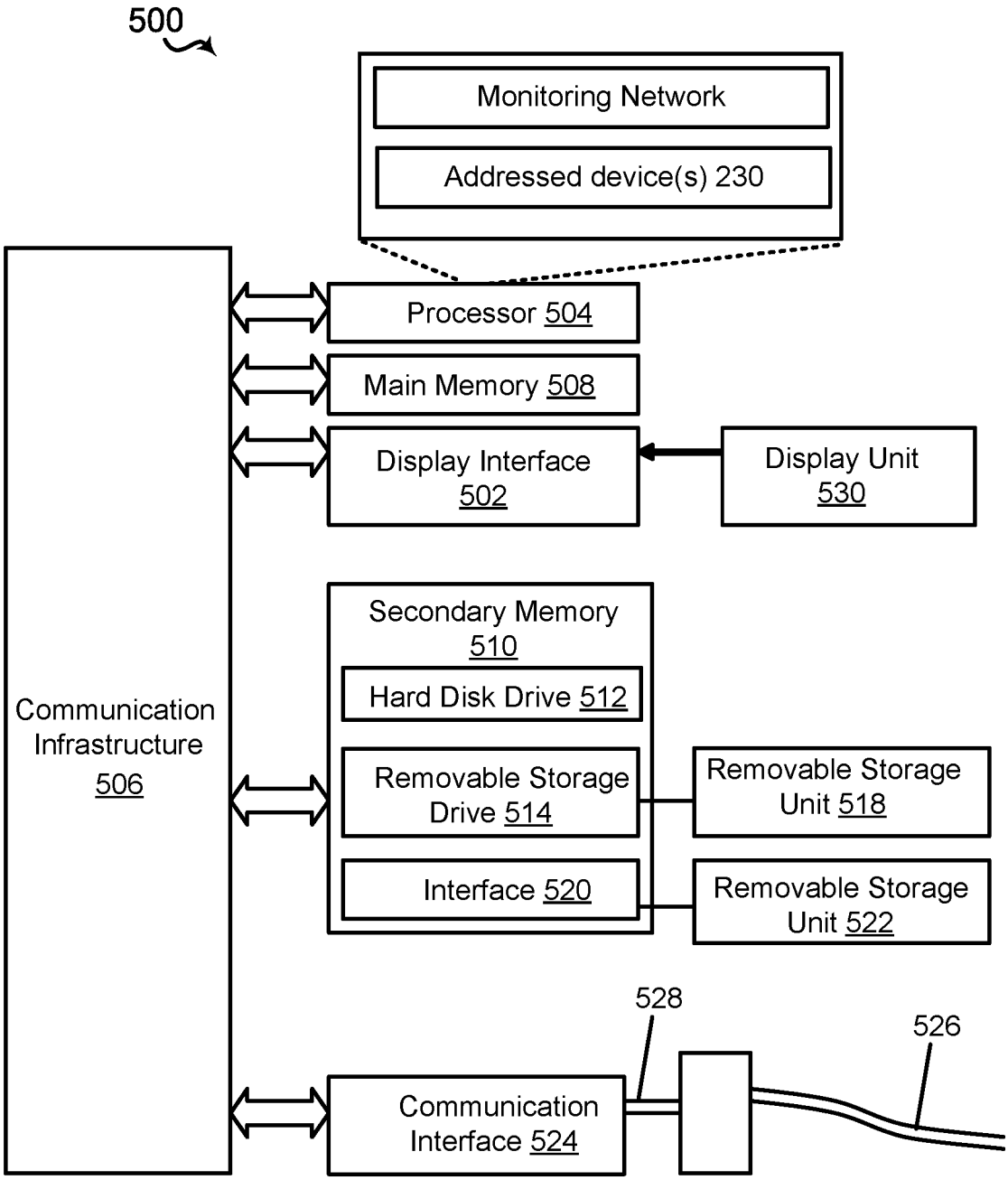
FIG. 8 illustrates an example of a computer system in accordance with aspects of the present disclosure.

Aspects of the present disclosures, such as the addressed device 230 and/or the monitoring network of a single or plurality of addressed device(s), may be implemented using hardware, software, or a combination thereof and may be implemented in one or more computer systems or other processing systems. In an aspect of the present disclosures, features are directed toward one or more computer systems capable of carrying out the functionality described herein, such as the example computer system 500 shown in FIG. 8.

The computer system 500 includes one or more processors, such as processor 504. The processor 504 is connected with a communication infrastructure 506 (e.g., a communications bus, cross-over bar, or network). Various software aspects are described in terms of this example computer system. After reading this description, it will become apparent to a person skilled in the relevant art(s) how to implement aspects of the disclosures using other computer systems and/or architectures.

The computer system 500 may include a display interface 502 that forwards graphics, text, and other data from the communication infrastructure 506 (or from a frame buffer not shown) for display on a display unit 530. Computer system 500 also includes a main memory 508, preferably random access memory (RAM), and may also include a secondary memory 510. The secondary memory 510 may include, for example, a hard disk drive 512, and/or a removable storage drive 514, representing a floppy disk drive, a magnetic tape drive, an optical disk drive, a universal serial bus (USB) flash drive, etc. The removable storage drive 514 reads from and/or writes to a removable storage unit 518 in a well-known manner. Removable storage unit 518 represents a floppy disk, magnetic tape, optical disk, USB flash drive etc., which is read by and written to removable storage drive 514. As will be appreciated, the removable storage unit 518 includes a computer usable storage medium having stored therein computer software and/or data. In some examples, one or more of the main memory 508, the secondary memory 510, the removable storage unit 518, and/or the removable storage unit 522 may be a non-transitory memory.

Alternative aspects of the present disclosures may include secondary memory 510 and may include other similar devices for allowing computer programs or other instructions to be loaded into computer system 500. Such devices may include, for example, a removable storage unit 522 and an interface 520. Examples of such may include a program cartridge and cartridge interface (such as that found in video game devices), a removable memory chip (such as an erasable programmable read only memory (EPROM), or programmable read only memory (PROM)) and associated socket, and other removable storage units 522 and interfaces 520, which allow software and data to be transferred from the removable storage unit 522 to computer system 500.

Computer system 500 may also include a communications interface 524. Communications interface 524 allows software and data to be transferred between computer system 500 and external devices. Examples of communications interface 524 may include a modem, a network interface (such as an Ethernet card), a communications port, a Personal Computer Memory Card International Association (PCMCIA) slot and card, etc. Software and data transferred via communications interface 524 are in the form of signals 528, which may be electronic, electromagnetic, optical or other signals capable of being received by communications interface 524. These signals 528 are provided to communications interface 524 via a communications path (e.g., channel) 526. This path 526 carries signals 528 and may be implemented using wire or cable, fiber optics, a telephone line, a cellular link, an RF link and/or other communications channels. In this document, the terms "computer program medium" and "computer usable medium" are used to refer generally to media such as a removable storage drive 518, a hard disk installed in hard disk drive 512, and signals 528. These computer program products provide software to the computer system 500. Aspects of the present disclosures are directed to such computer program products.

Computer programs (also referred to as computer control logic) are stored in main memory 508 and/or secondary memory 510. Computer programs may also be received via communications interface 524. Such computer programs, when executed, enable the computer system 500 to perform the features in accordance with aspects of the present disclosures, as discussed herein. In particular, the computer programs, when executed, enable the processor 504 to perform the features in accordance with aspects of the present disclosures. Accordingly, such computer programs represent controllers of the computer system 500.

In an aspect of the present disclosures where the method is implemented using software, the software may be stored in a computer program product and loaded into computer system 500 using removable storage drive 514, hard drive 512, or communications interface 520. The control logic (software), when executed by the processor 504, causes the processor 504 to perform the functions described herein. In another aspect of the present disclosures, the system is implemented primarily in hardware using, for example, hardware components, such as application specific integrated circuits (ASICs). Implementation of the hardware state machine so as to perform the functions described herein will be apparent to persons skilled in the relevant art(s).

Figure 9:
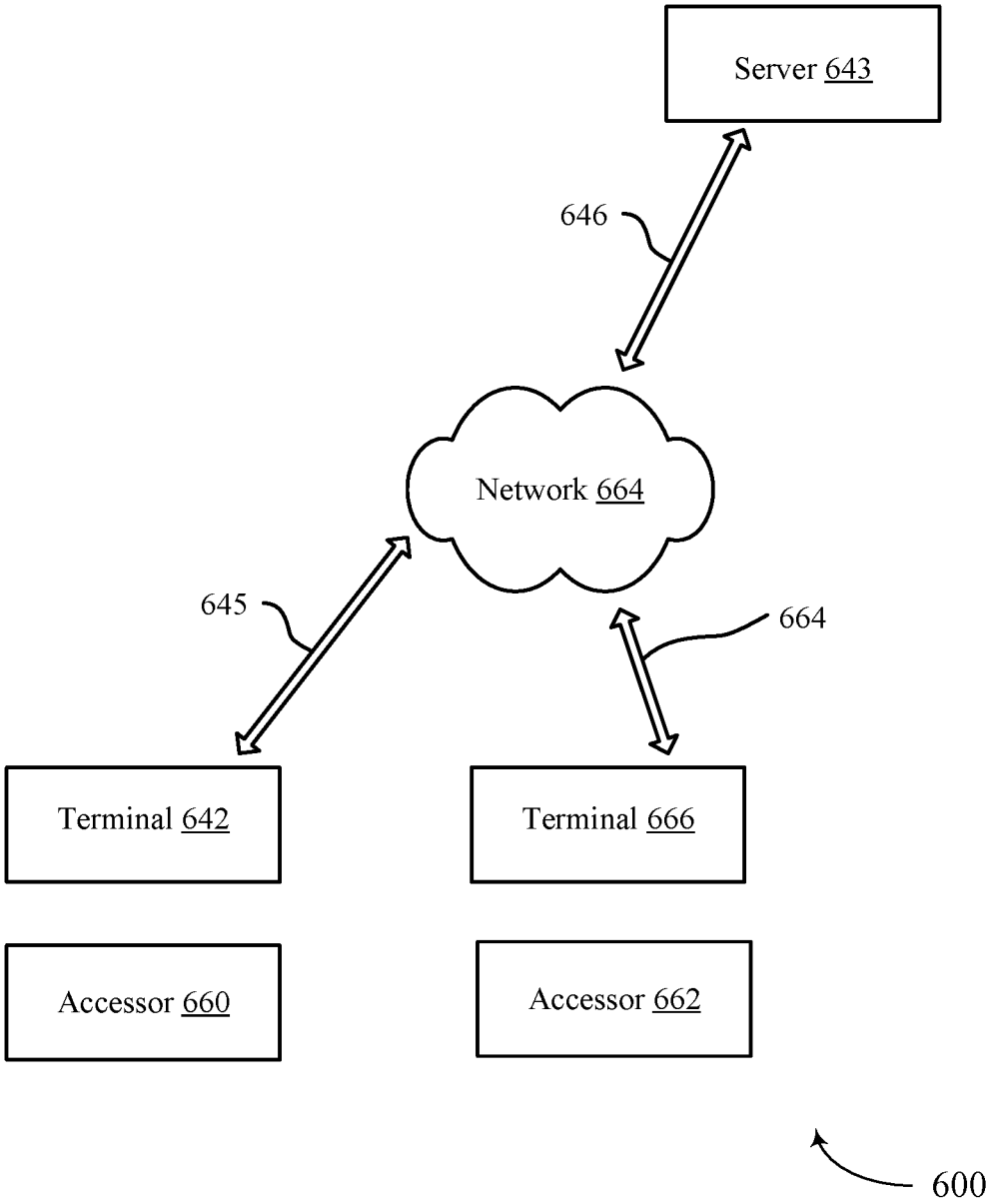
FIG. 9 is a block diagram of various example system components usable in accordance with an aspect of the disclosure.

FIG. 9 is a representative diagram of various system components for use on a network, in accordance with aspects of the present disclosure. The network system 600 of FIG. 9 includes one or more accessors 660, 662 (also referred to interchangeably herein as one or more "devices") and one or more terminals 642, 666. Terminals 642, 666 may provide data processing application or monitoring of one or more of the addressed devices along the lines in FIG. 6. In one aspect, data for use in accordance with aspects described herein may, be input and/or accessed by accessors 660, 662 via terminals 642, 666, such as personal computers (PCs), minicomputers, mainframe computers, microcomputers, or other device having a processor and a repository for data and/or connection to a repository for data, via, a network 644, such as the Internet or an intranet, and couplings 645, 646, 664. The couplings 645, 646, 664 include, wired, wireless, or fiber-optic links. The server 643, may comprise or be coupled, in turn, to a controller for the addressed device or devices along the lines of FIGS. 1-6.

The aspects discussed herein can also be described and implemented in the context of computer-readable storage medium storing computer-executable instructions. Computer-readable storage media includes computer storage media and communication media such as flash memory drives, digital versatile discs (DVDs), compact discs (CDs), floppy disks, and tape cassettes. Computer-readable storage media can include volatile and nonvolatile, removable and non-removable media implemented in any method or technology for storage of information such as computer readable instructions, data structures, modules or other data.

The term "processor," as used herein, can refer to a device that processes signals and performs general computing and arithmetic functions. Signals processed by the processor can include digital signals, data signals, computer instructions, processor instructions, messages, a bit, a bit stream, or other computing that can be received, transmitted and/or detected. A processor, for example, can include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described herein.

The term "bus," as used herein, can refer to an interconnected architecture that is operably connected to transfer data between computer components within a singular or multiple systems. The bus can be a memory bus, a memory controller, a peripheral bus, an external bus, a crossbar switch, and/or a local bus, among others.

The term "memory," as used herein, can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

The foregoing description of various aspects and examples have been presented for purposes of illustration and description. It is not intended to be exhaustive nor to limit the disclosure to the forms described. The embodiment(s) illustrated in the figures can, in some instances, be understood to be shown to scale for illustrative purposes. Numerous modifications are possible in light of the above teachings, including a combination of the above-mentioned aspects. Some of those modifications have been discussed and others will be understood by those skilled in the art. The various aspects were chosen and described in order to best illustrate the principles of the present disclosure and various aspects as are suited to the particular use contemplated. The scope of the present disclosure is, of course, not limited to the examples or aspects set forth herein, but can be employed in any number of applications and equivalent devices by those of ordinary skill in the art. Rather, it is hereby intended the scope be defined by the claims appended hereto.

What is claimed is:

1. An addressing device, comprising:

a mounting base configured to be removably engaged with a corresponding mounting portion of an addressed device, wherein being removably engaged includes being moveable from a non-engaged position to an engaged position;

a constant contact configured to contact a respective addressed device constant contact when the addressing device and the addressed device are in the engaged position;

a first contact that is electrically connected to the constant contact;

a first switch configured to move the first contact from a first position to a second position, wherein in the first position the first contact forms an electrical connection with a first addressed device contact when the addressing device and the addressed device are in the engaged position, and wherein in the second position the first contact forms an open electrical connection with the first addressed device contact when the addressing device and the addressed device are in the engaged position;

a second contact that is electrically connected to the constant contact and the first contact; and a second switch configured to move the second contact from a third position to a fourth position, wherein in the third position the second contact forms an electrical connection with a second addressed device contact when the addressing device and the addressed device are in the engaged position, and wherein in the fourth position the second contact forms an open electrical connection with the second addressed device contact when the addressing device and the addressed device are in the engaged position.

2. The addressing device of claim 1, wherein an address of the addressed device is set by the addressing device when the addressing device and the addressed device are in the engaged position.

3. The addressing device of claim 1, wherein the addressed device comprises a sensor and the addressing device is a mount for the addressed device.

4. The addressing device of claim 1, wherein the first contact and the second contact are biasing members respectively capable of contacting a corresponding one of the first addressed device contact and the second addressed device contact.

5. The addressing device of claim 4, wherein the first switch is rotatable about a first axis and comprises a first portion and a second portion that extends further from the first axis than the first portion, wherein when the first switch is moved from the first position to the second position, the second portion makes contact with and presses against the first contact thereby preventing contact between the second contact and the second addressed device contact when the addressed device and addressing device are in an engaged position.

6. The addressing device of claim 5, wherein when the first switch is moved from the second position to the first position the first portion rotates out of contact with the first contact thereby causing the second contact to contact the second addressed device contact when the addressed device and addressing device are in an engaged position.

7. A combined device, comprising:

an addressed device;

an addressing device that is configured to be removably engaged with the addressed device, wherein the addressing device further comprises:

a constant contact configured to contact a corresponding addressed device constant contact when the addressing device and the addressed device are in an engaged position;

a first contact that is electrically connected to the constant contact;

a first switch configured to move the first contact from a first position to a second position, wherein in a first position the first contact forms an electrical connection with a first addressed device contact when the addressing device and the addressed device are in the engaged position, and wherein in the second position the first contact forms an open electrical connection with the first addressed device contact when the addressing device and the addressed device are in the engaged position;

a second contact that is electrically connected to the constant contact and the first contact; and a second switch configured to move the second contact from a third position to a fourth position, wherein in the third position the second contact forms an electrical connection with a second addressed device contact when the addressing device and the addressed device are in the engaged position, and wherein in the fourth position the second contact forms an open electrical connection with the second addressed device contact when the addressing device and the addressed device are in the engaged position.

8. The combined device of claim 7, wherein an address of the addressed device is set by the addressing device when the addressing device and the addressed device are in the engaged position.

9. The combined device of claim 7, wherein the addressed device comprises a sensor and the addressing device is a mount for the addressed device.

10. The combined device of claim 7, wherein the first contact and the second contact are biasing members respectively capable of contacting the respective one of the first addressed device contact and the second addressed device contact.

11. The combined device of claim 7 wherein the first switch is rotatable about a first axis and comprises a first portion and a second portion that extends further from the first axis than the first portion, wherein when the first switch is moved from the first position to the second position, the second portion makes contact with and presses against the first contact thereby preventing contact between the second contact and the second addressed device contact when the addressed device and addressing device are in an engaged position.

12. The combined device of claim 11, wherein when the first switch is moved from the second position to the first position the first portion rotates out of contact with the first contact thereby causing the second contact to contact the second addressed device contact when the addressed device and addressing device are in an engaged position.

13. An addressed device configured to be removeably engaged with and addressed by an addressing device comprising a constant contact, a first contact, and a second contact, the addressed device comprising:

an addressed device constant contact configured to provide continuity with a constant contact of the addressing device when the addressing device and the addressed device are in an engaged position;

a first addressed device contact configured to be selectively contacted by a first contact of the addressing device when the addressing device and addressed device are in the engaged position;

a second addressed device contact configured to be selectively contacted by the second contact of the addressed device when the addressing device and addressed device are in the engaged position, wherein the selective engagement of the first addressing device contact and the second addressing device contact with the first addressed device contact and the second addressed device contact provides a continuity sequence which sets an address of the addressed device.

14. The addressed device of claim 13, wherein the addressed device comprises a sensor and the addressing device is a mount for the addressed device.

15. The addressed device of claim 14, wherein the addressed device is configured to engage with the addressing device via rotational engagement.

16. The addressed device of claim 13, wherein the first addressed device contact and the second addressed device contact align with, and are capable of receiving a biasing force from the respective first addressing device contact and the second addressing device contact when the addressing device and the addressed device are in the engaged position.

17. The addressed device of claim 13, wherein when a first switch of the addressing device is in a first position, the first addressing device contact applies a biasing force to and provides continuity with the first addressed device contact when the addressing device and the addressed device are in the engaged position, and wherein when the first switch of the addressing device is in a second position, the first addressing device contact does not apply a biasing force to and forms an open electrical contact with the first addressed device contact when the addressing device and the addressed device are in the engaged position, wherein the addressed device is configured to set the address of the addressing device to a first address when the first switch is in a first position and the addressed device is configured to set the address of the addressing device to a second address when the first switch in the second position.

* * * * *